US012708186B2

(12) United States Patent
Maeda

(10) Patent No.: US 12,708,186 B2
(45) Date of Patent: Aug. 18, 2026

(54) HAIR DRYER AND ELECTRIC MOTOR

(71) Applicant: YA-MAN LTD., Tokyo (JP)

(72) Inventor: Kazunori Maeda, Tokyo (JP)

(73) Assignee: YA-MAN LTD. (JP)

( * ) Notice: Subject to any disclaimer, the term of this patent is extended or adjusted under 35 U.S.C. 154(b) by 518 days.

(21) Appl. No.: 18/364,589

(22) Filed: Aug. 3, 2023

(65) Prior Publication Data

US 2023/0371672 A1 Nov. 23, 2023

Related U.S. Application Data

(63) Continuation of application No. PCT/JP2021/032892, filed on Sep. 7, 2021.

(30) Foreign Application Priority Data

May 19, 2021 (JP) ..... 2021-084642

(51) Int. Cl.
*A45D 20/12* (2006.01)

(52) U.S. Cl.
CPC ..... *A45D 20/12* (2013.01); *A45D 2200/202* (2013.01); *A45D 2200/205* (2013.01)

(58) Field of Classification Search
CPC ..... A45D 20/12; A45D 2200/202; A45D 2200/205; H02K 5/18; H02K 7/14
See application file for complete search history.

(56) References Cited

U.S. PATENT DOCUMENTS

| | | | | |
|---|---|---|---|---|
| 2013/0326898 | A1 | 12/2013 | Quessard et al. | |
| 2021/0307474 | A1* | 10/2021 | Conrad | A45D 20/12 |

FOREIGN PATENT DOCUMENTS

| | | | |
|---|---|---|---|
| CN | 207705984 | U | 8/2018 |
| CN | 108678993 | A | 10/2018 |
| CN | 209516803 | U | 10/2019 |
| CN | 110768437 | A | 2/2020 |
| JP | S61-217648 | A | 9/1986 |
| JP | H07-265120 | A | 10/1995 |
| JP | 2005-137064 | A | 5/2005 |
| JP | 2010-062159 | A | 3/2010 |
| JP | 2013-111225 | A | 6/2013 |
| JP | 2014-046090 | A | 3/2014 |
| JP | 2014-094240 | A | 5/2014 |
| JP | 6053906 | B1 | 12/2016 |
| JP | 3219559 | U | 1/2019 |

(Continued)

OTHER PUBLICATIONS

Translation, WO-2021227962-A1 (Year: 2021).*

(Continued)

*Primary Examiner* — Jessica Yuen

(74) *Attorney, Agent, or Firm* — Harness, Dickey & Pierce, P.L.C.

(57) ABSTRACT

A hair dryer is provided. The hair dryer has a main body unit, a blower, and a driver. The main body unit includes an inlet port at one end and an outlet port at the other end. The blower is disposed in the main body unit and configured to generate, in the main body unit, airflow flowing from the inlet port to the outlet port. The driver includes a motor and a frame and configured to drive the blower by a rotation of the motor. The frame includes a heat dissipater. The heat dissipater is configured to dissipate, using the airflow, heat generated in a winding of the motor.

21 Claims, 23 Drawing Sheets

(56) References Cited

FOREIGN PATENT DOCUMENTS

| | | | | |
|---|---|---|---|---|
| JP | 2019-058484 | A | 4/2019 | |
| JP | 2020-062401 | A | 4/2020 | |
| JP | 2020-199019 | A | 12/2020 | |
| WO | 2020-070032 | A1 | 4/2020 | |
| WO | 2020-231033 | A1 | 11/2020 | |
| WO | WO-2021227962 | A1 * | 11/2021 | ..... H05B 3/02 |

OTHER PUBLICATIONS

Office Action issued in the corresponding Japanese Patent Application No. 2024-157155; mailed Apr. 30, 2025 (total 8 pages).
International Search Report issued in the corresponding International Application No. PCT/JP2021/032892; mailed on Nov. 9, 2021 (total 7 pages).
Office Action issued in the corresponding Chinese Patent Application No. 202180093465.4; dated Aug. 16, 2025 (total 21 pages).
Office Action issued in the corresponding Japanese Patent Application No. 2021-555242; mailed on Feb. 6, 2024 (total 6 pages).
European Search Report issued in the corresponding European Patent Application No. 21940890.3; dated Sep. 25, 2024 (total 13 pages).

* cited by examiner

FIG. 17

| MODE | SCULP MOISTURE HEAD NOT ATTACHED | | SCULP MOISTURE HEAD NOT ATTACHED | | SCULP MOISTURE HEAD ATTACHED (HEAD MODE) | | SCULP MOISTURE HEAD ATTACHED (FACE MODE) | |
|---|---|---|---|---|---|---|---|---|
| | TEMPERA-TURE | AIR AMOUNT | TEMPERA-TURE | AIR AMOUNT | TEMPERA-TURE | AIR AMOUNT | TEMPERA-TURE | AIR AMOUNT |
| TURBO | 60°C | 103,000 RPM | ROOM TEMPERA-TURE | 103,000 RPM | 50°C | 28,000 RPM | 39°C | 14,000 RPM |
| DRY | 80°C | 70,000 RPM | | 70,000 RPM | | | | |
| SET | 50°C | 55,000 RPM | | 55,000 RPM | | | | |

FIG. 22

| MODE | SW1 | | | HEATER | | | MOTOR | | TEMPE-RATURE | AIR AMOUNT |
|---|---|---|---|---|---|---|---|---|---|---|
| | SW11 | SW12 | SW13 | R1 | R2 | R3 | S1 | S2 | | |
| TURBO | ON | OFF | ON | HALF WAVE | HALF WAVE | FULL WAVE | HALF WAVE | FULL WAVE | 60°C | 103,000 RPM |
| DRY | OFF | ON | ON | FULL WAVE | FULL WAVE | FULL WAVE | HALF WAVE | HALF WAVE | 80°C | 70,000 RPM |
| SET | OFF | OFF | ON | — | — | FULL WAVE | HALF WAVE | — | 50°C | 55,000 RPM |
| OFF | OFF | OFF | OFF | — | — | — | — | — | — | — |

HAIR DRYER AND ELECTRIC MOTOR

CROSS REFERENCE TO RELATED APPLICATIONS

This application is a continuation of International Application No. PCT/JP2021/032892 filed Sep. 7, 2021, which claims priority to Japanese Patent Application No. 2021-084642 filed May 19, 2021, which are both expressly incorporated by reference herein in their entireties.

BACKGROUND

Technical Field

The present invention relates to a hair dryer and an electric motor.

Related Art

In hair dryers with large air volume, motors and their control circuits generate large amounts of heat. For this reason, a technology capable of efficiently dissipating heat from the control circuit has been proposed (refer to, for example, Japanese Patent Application Publication No. 2020-199019).

There is a need for hair dryers having multiple functions. When a hair dryer is multifunctional, a user may move the hair dryer to various angles with respect to the head. Thus, for the convenience of the user, it is desirable to make the hair dryer smaller.

On the other hand, when a hair dryer is made small, it is difficult to efficiently dissipate heat from the motor or the like.

In view of the above circumstances, the present invention provides a hair dryer and an electric motor each of which can efficiently dissipate heat generated by a motor.

SUMMARY

According to an aspect of the present invention, a hair dryer is provided. This hair dryer has a main body unit, a blower, and a driver. The main body unit includes an inlet port at one end and an outlet port at the other end. The blower is disposed in the main body unit and configured to generate, in the main body unit, airflow flowing from the inlet port to the outlet port. The driver includes a motor and a frame and configured to drive the blower by a rotation of the motor. The frame includes a heat dissipater. The heat dissipater is configured to dissipate, using the airflow, heat generated in a winding of the motor.

According to one aspect of the present invention, heat generated by a motor can be efficiently dissipated, making it possible to easily make the hair dryer smaller.

BRIEF DESCRIPTION OF THE DRAWINGS

FIG. 17 is a diagram illustrating an example of control by an output control unit 61.

FIG. 22 is a diagram for describing an operation of the circuit illustrated in FIG. 21.

DETAILED DESCRIPTION

Hereinafter, a description will be given of an embodiment of the present disclosure with reference to drawings. Various features described in the following embodiment can be combined with each other.

A term "unit" in the present embodiment may include, for example, a combination of a hardware resource implemented as circuits in a broad sense and information processing of software that can be concretely realized by the hardware resource. Furthermore, various types of information are described in the present embodiment, and such information may be represented by, for example, physical values of signal values representing voltage and current, high and low signal values as a set of binary bits consisting of 0 or 1, or quantum superposition (so-called qubits), and communication and computation may be executed on a circuit in a broad sense.

The circuit in a broad sense is a circuit realized by properly combining at least a circuit, circuitry, a processor, a memory, and the like. In other words, a circuit includes an application specific integrated circuit (ASIC), a programmable logic device (e.g., simple programmable logic device (SPLD), a complex programmable logic device (CLPD), field programmable gate array (FPGA), and the like.

1. Overall Configuration

Figure 1:
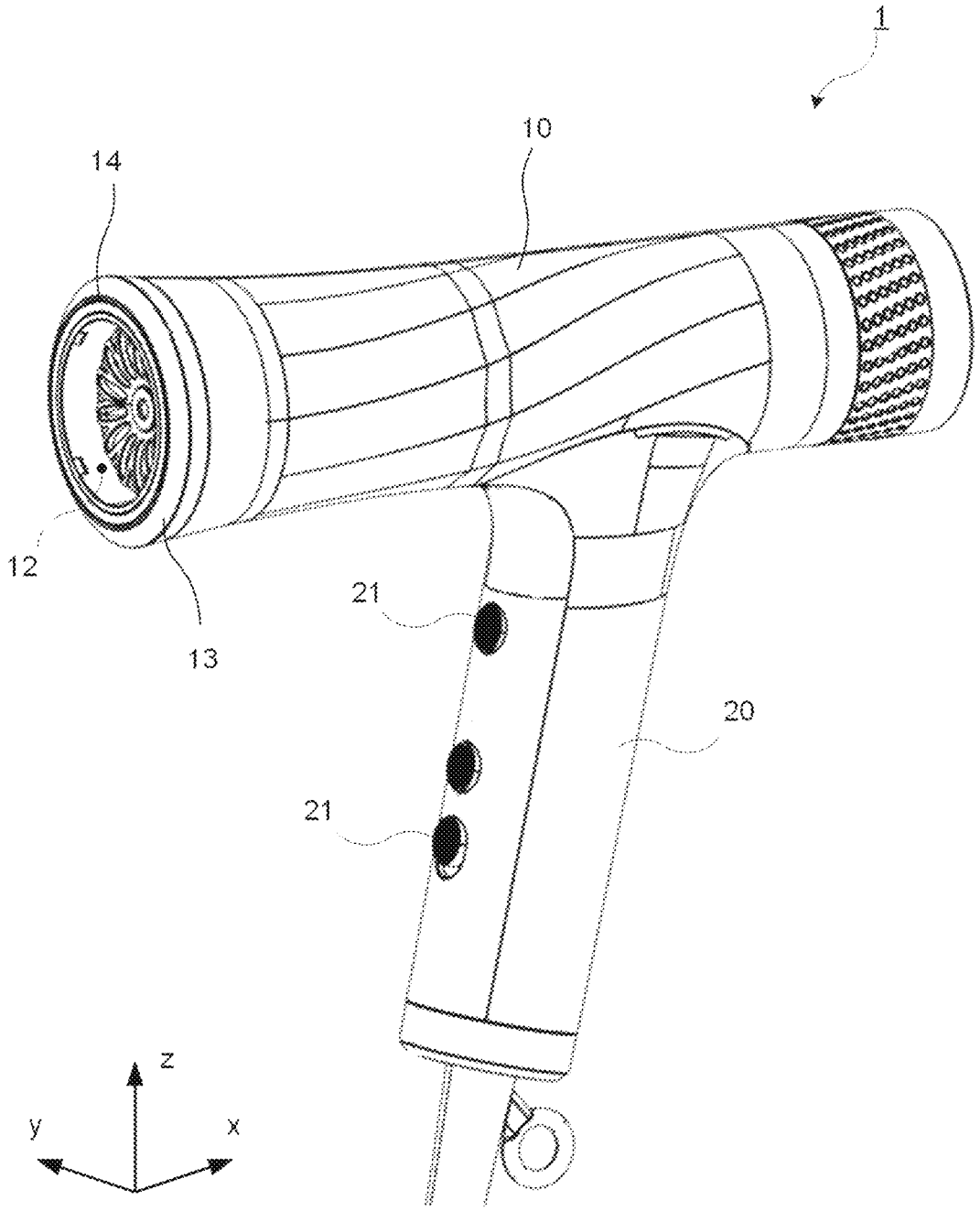
FIG. 1 is a perspective view illustrating an external appearance of a hair dryer 1.
Figure 2:
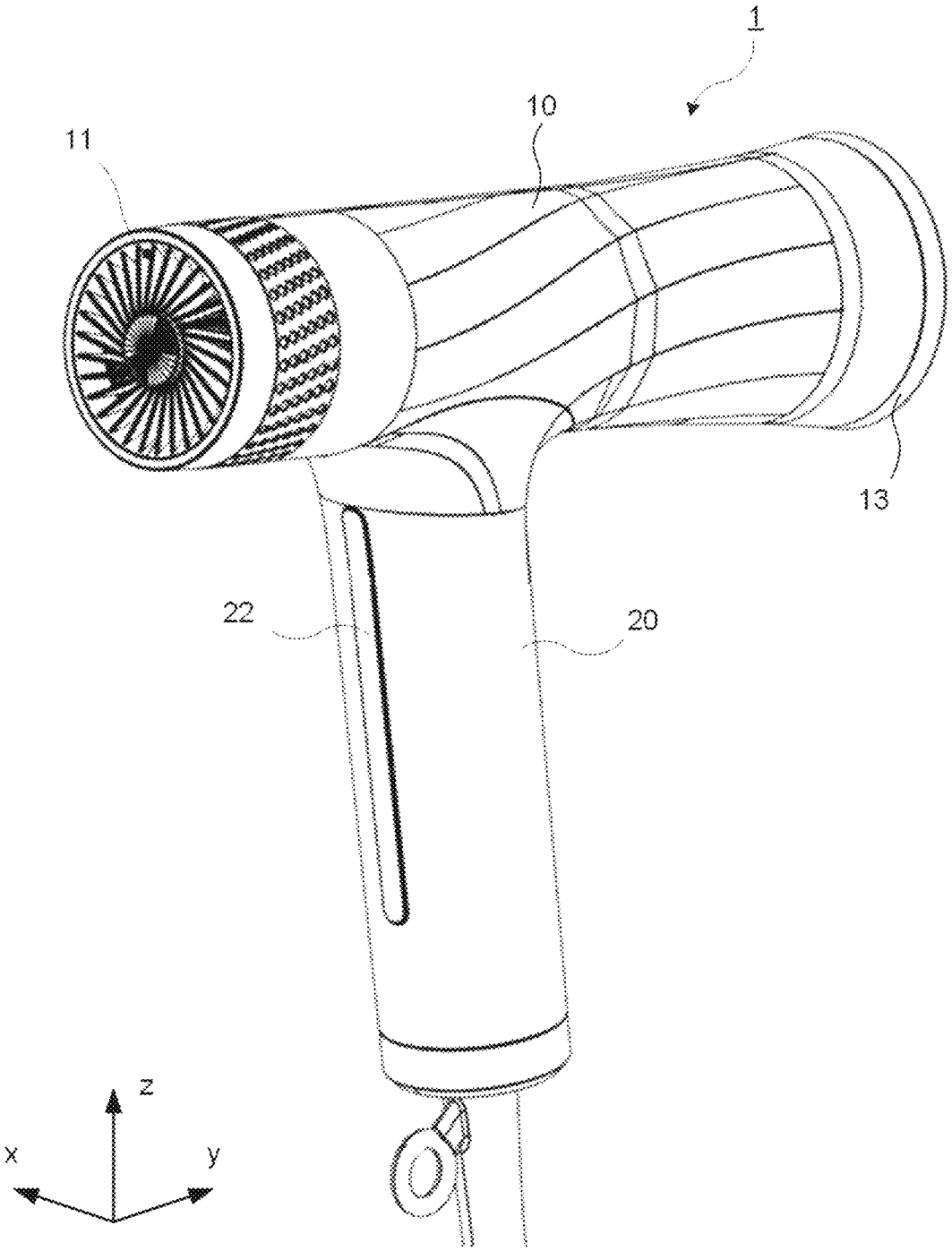
FIG. 2 is a perspective view illustrating an external appearance of the hair dryer 1.
Figure 3:
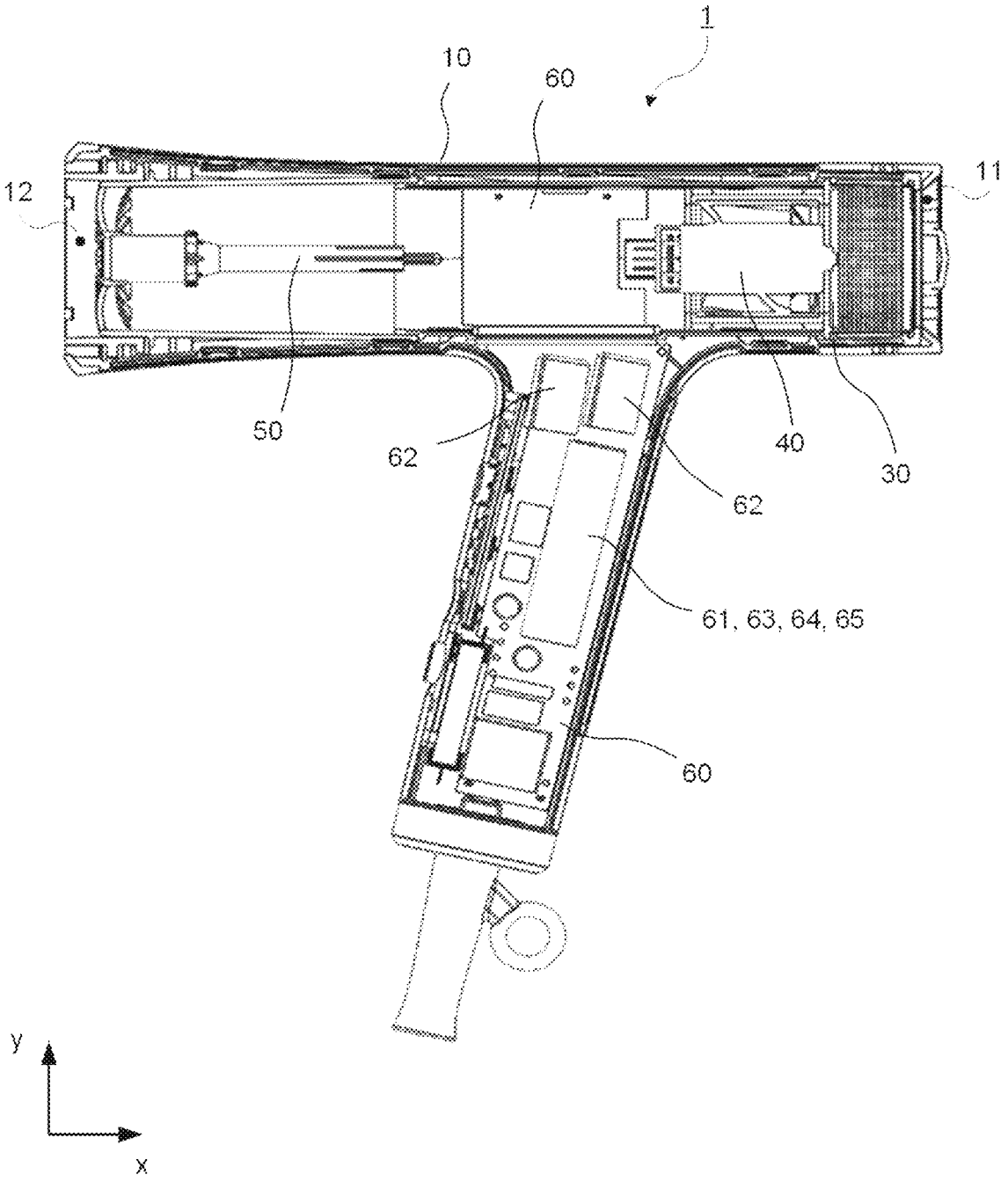
FIG. 3 is a sectional view of the hair dryer 1.

FIG. 1 and FIG. 2 are perspective views illustrating an external appearance of a hair dryer 1, and FIG. 3 is a sectional view of the hair dryer 1. The hair dryer 1 includes a main body unit 10 and a grip unit 20. The main body unit 10 has a cylindrical shape and includes an inlet port 11 at one end and an outlet port 12 at the other end. In the vicinity of the outlet port 12, an expander 13 and a light emission unit 14 are provided. The grip unit 20 is a unit gripped by a user of the hair dryer 1 and includes a switch 21 and a hand electrode 22, the hand electrode 22 being part of a charge collector.

The hair dryer 1 includes inside a blower 30, a driver 40, a heater 50, and a substrate 60. The substrate 60 includes an output control unit 61 as an output controller, an ionizer 62 as a charge emitter, a charged state detection unit 63 as a charged state detector, and a charge emission control unit 64 as a charge emission controller.

2. Blower and Driver

Figure 4:
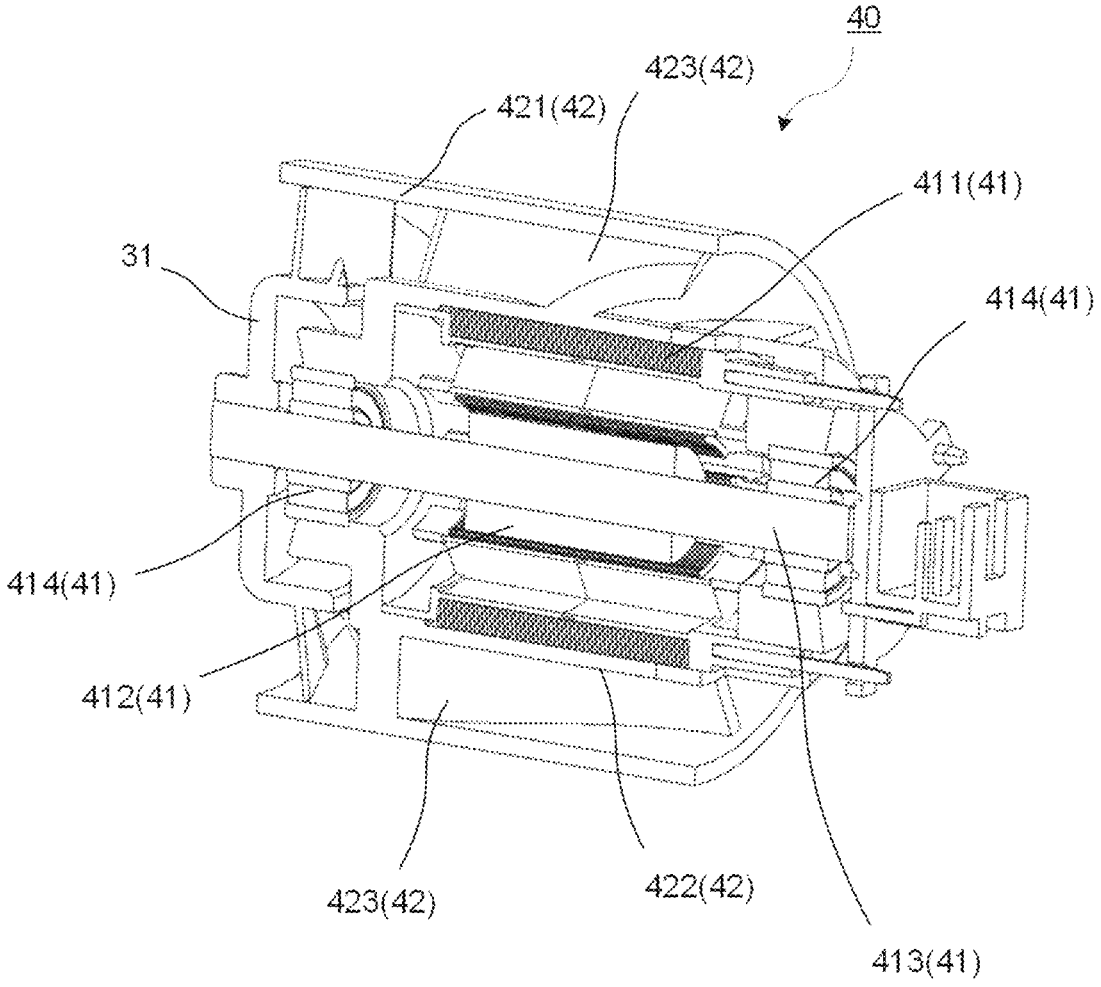
FIG. 4 is a perspective sectional view of a blower 30 and a driver 40.

Next, a description will be given of the blower 30 and the driver 40. FIG. 4 is a perspective sectional view of the blower 30 and the driver 40. The blower 30 is disposed in the main body unit 10 and is configured to generate an airflow in the main body unit 10, an airflow flowing from the inlet port 11 to the outlet port 12. The blower 30 is, for example, an impeller 31. The impeller 31 is made of, for example, magnesium or a magnesium alloy. This allows the impeller 31 to be relatively light (the specific gravity of aluminum is 2.7 and the specific gravity of magnesium is 1.7), making the hair dryer 1 lighter and less likely to abnormally vibrate even when balance is deviated by manufacturing variations. Furthermore, the hair dryer 1 has high resistance to heat and time, and therefore its rigidity and shape do not change, which can provide stable performance over a long period. Thus, it is easy to design a small and high-revolution impeller.

The driver 40 includes a motor 41 and a frame 42 and is configured to drive the blower 30 by rotation of the motor 41. The motor 41 includes a stator 411, a rotor 412, a shaft 413, and a bearing 414. The stator 411 includes, for example, a winding. By an electric current flowing through the winding, a rotating magnetic field is generated around the rotor 412. The rotor 412 includes, for example, a permanent magnet. Since the rotor 412 includes the permanent magnet, the rotor 412 rotates about the shaft 413 in response to the rotating magnetic field. The shaft 413 is a rotation axis, and the bearing 414 supports the shaft 413 and reduces friction when the shaft 413 rotates.

The frame 42 includes an inner wall 421, an outer wall 422, and a heat dissipater 423.

The inner wall 421 encases the motor 41 including the winding (stator 411). Part of the airflow generated by the blower 30 may flow on an inner side the inner wall 421. The outer wall 422 is located outside the inner wall 421, and the airflow generated by the blower 30 flows between the inner wall 421 and the outer wall 422. In a case where the airflow flows on the inner side of the inner wall 421, the airflow flowing through between the inner wall 421 and the outer wall 422 is also part of the airflow generated by the blower 30.

The heat dissipater 423 is disposed between the inner wall 421 and the outer wall 422 and is configured to support the outer wall 422 by connecting the inner wall 421 and the outer wall 422 and to dissipate, using the airflow, heat generated in the winding of the motor. For this purpose, the heat dissipater 423 may be made of aluminum or aluminum alloy and may be integrally formed with the inner wall 421 and the outer wall 422. The heat dissipater 423 may have a plate-like shape whose surface is parallel to the direction of the flow of the airflow, or may have a shape such that the heat dissipater 423 operates as a diffuser vane configured to regulate the airflow.

Thus, the heat dissipater 423 preheats the airflow while dissipating the heat generated in the motor 41. This facilitates a small and light design with low power consumption.

3. Inlet Port

Figure 5:
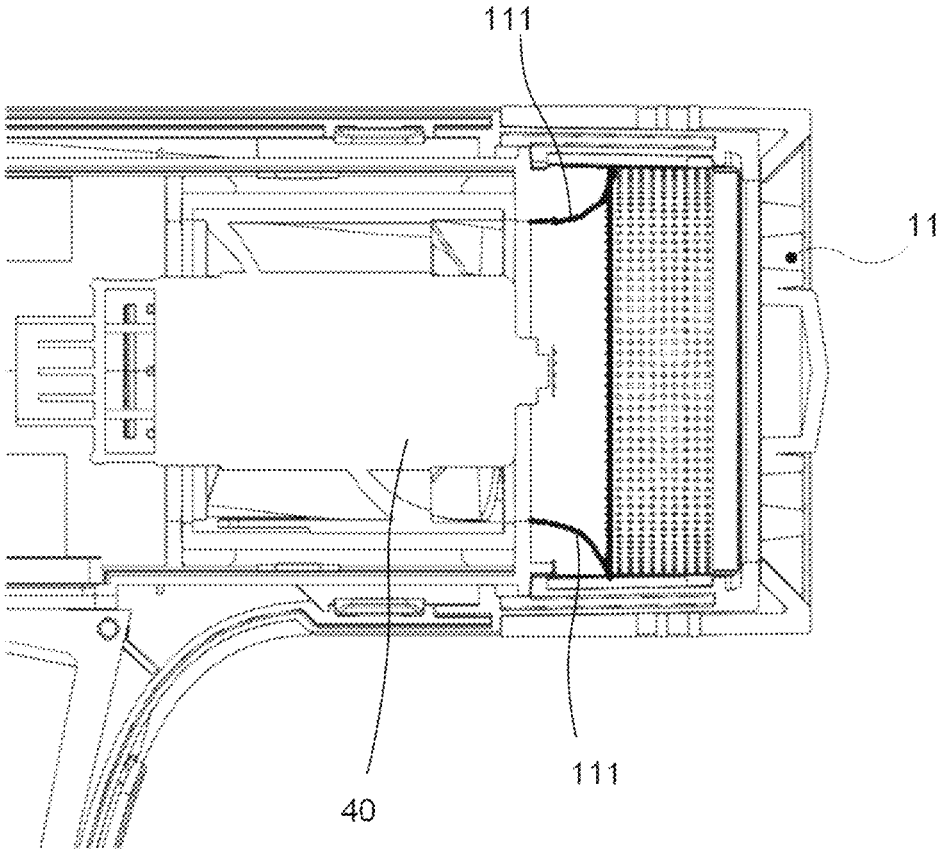
FIG. 5 is a sectional view of an inlet port 11.

Next, the inlet port 11 will be described. FIG. 5 is a sectional view of the inlet port 11. As illustrated in the drawing, the inlet port 11 has a shape such that the section of a flow path 111 of the airflow varies continuously. This shape is similar to the shape a funnel and regulates the flow of the airflow entering from the outside to the inside of the main body unit 10. Specifically, the flow path 111 of the airflow is formed in a shape such that the diameter is larger on the outside side of the main body unit 10 and smaller on the side of the blower 30.

4. Outlet Port

Figure 6:
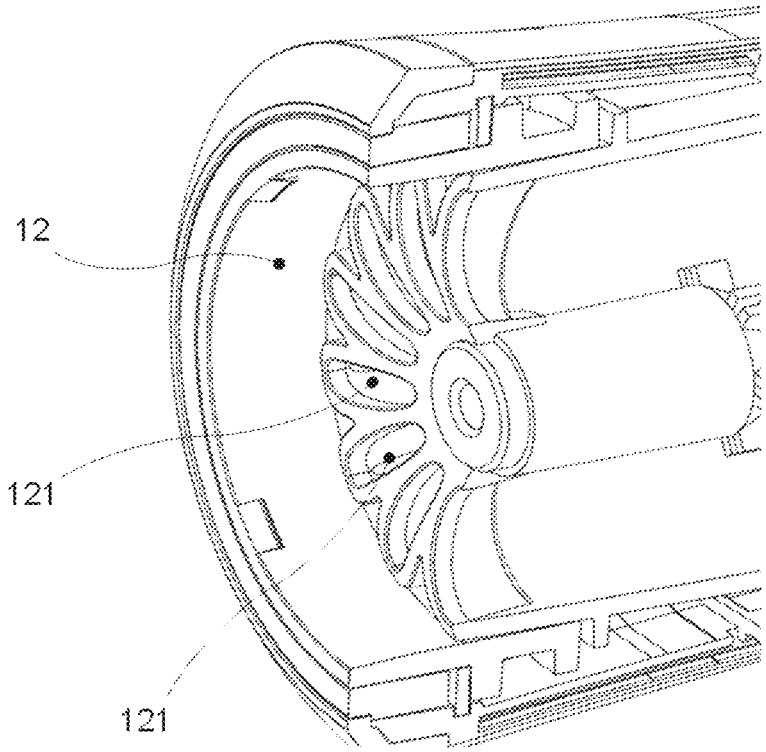
FIG. 6 is a perspective sectional view of the outlet port 12.

Next, the outlet port 12 will be described. FIG. 6 is a perspective sectional view of the outlet port 12. As illustrated in the drawing, the outlet port 12 includes two or more blow ports 121. Each of the blow ports 121 has a shape that continuously narrows the flow path of the airflow and thereafter continuously widens it.

Figure 7:
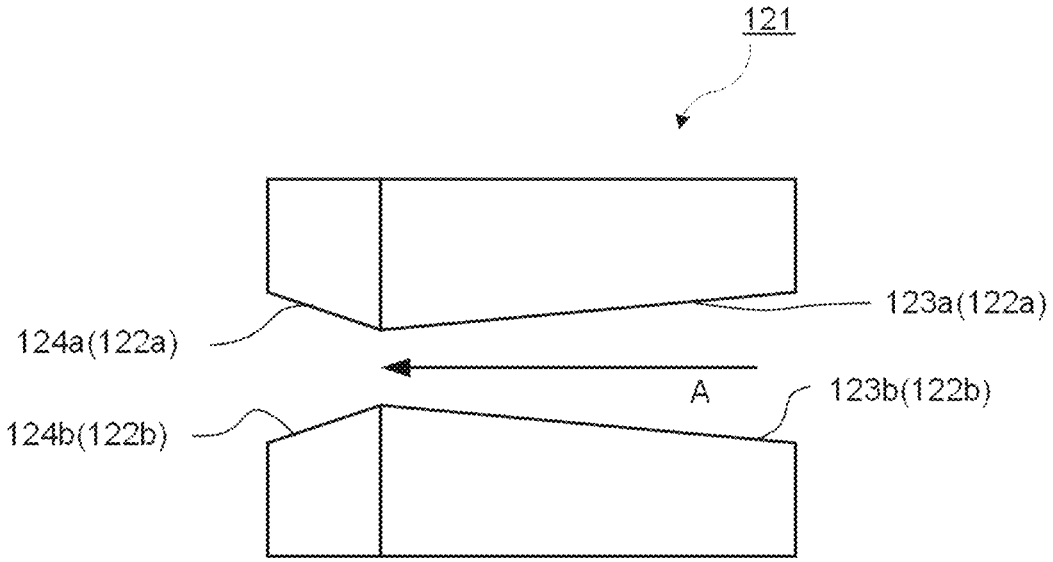
FIG. 7 is a diagram illustrating a sectional shape of a flow path surface.
Figure 8:
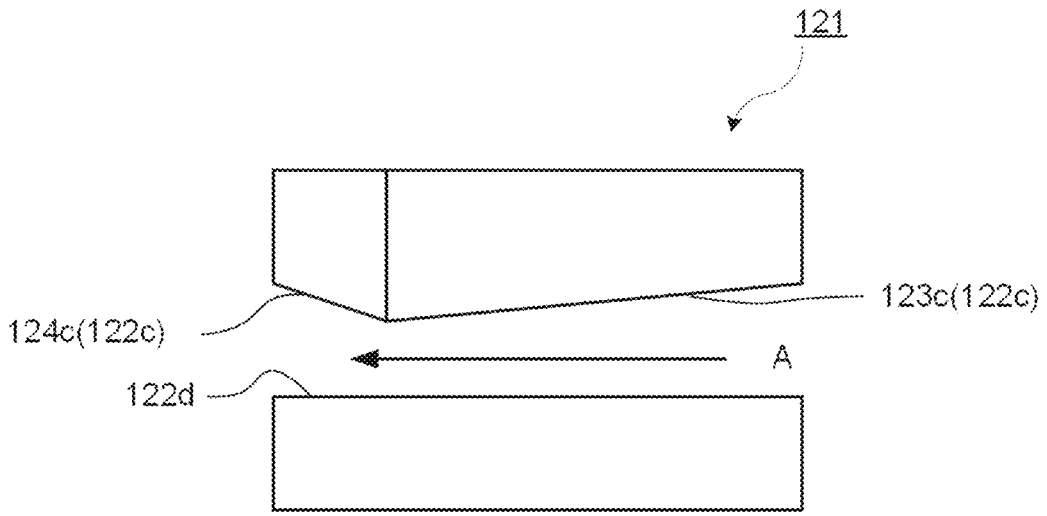
FIG. 8 is a diagram illustrating a sectional shape of the flow path surface.

Here, a description will be given of the flow path of the airflow at the blow ports 121. FIG. 7 and FIG. 8 are diagrams each illustrating a sectional shape of the flow path surfaces. As illustrated in FIG. 7, a blow port 121 includes a flow path surface 122*a* and a flow path surface 122*b*. The flow path surface 122*a* includes a slope 123*a* and a slope 124*a*, and the flow path surface 122*b* includes a slope 123*b* and a slope 124*b*. An arrow A in the drawing represents a flowing direction of the airflow. The slope 123*a* and the slope 123*b* gradually narrow the flow path of the airflow, and the slope 124*a* and the slope 124*b* gradually widen the flow path of the airflow. As illustrated in FIG. 8, a blow port 121 may include a flow path surface 122*c* and a flow path surface 122*d*, where the flow path surface 122*c* includes a slope 123*c* and a slope 124*c*. Thus, the flow path surface 122*c* is longer and has a gentler angle than the flow path surface 122*d*.

By forming the blow ports 121 in this way, that is, by gradually narrowing the flow path of the airflow, the air velocity of the airflow can be increased, and then by widening the flow path, air blowing out from the blow ports 121 can be expanded. By increasing the air velocity of the air blowing out from the blow ports 121, the air can be made to reach the root of the hair and to dry it, and by widening the air, the air can softly blow on the hair, hindering the hair from tangling.

Figure 9:
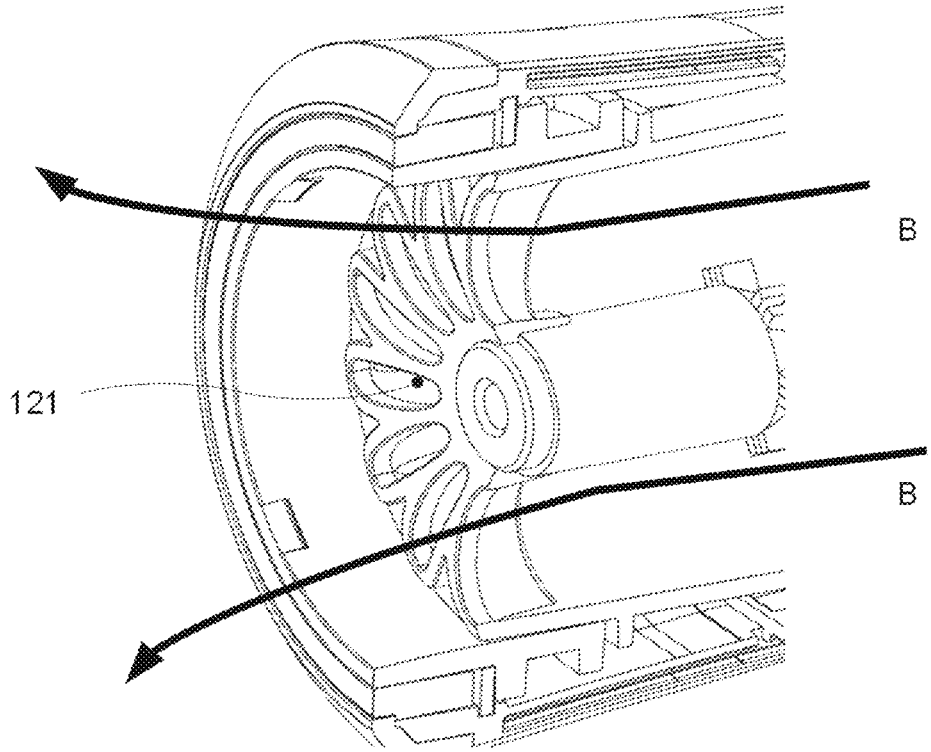
FIG. 9 is a diagram illustrating a direction of an airflow curved in an outer circumference direction of the outlet port 12.

In order to expand the air blowing out from the blow ports 121, each of the blow ports 121 may have a shape that curves the direction of the airflow toward an outer circumference direction of the outlet port 12. In this case, the direction of the airflow is the direction represented by the arrow B illustrated in FIG. 9. FIG. 9 is a diagram illustrating the direction of the airflow curved toward the outer circumferential direction of the outlet port 12.

5. Light Emission Unit

Figure 10:
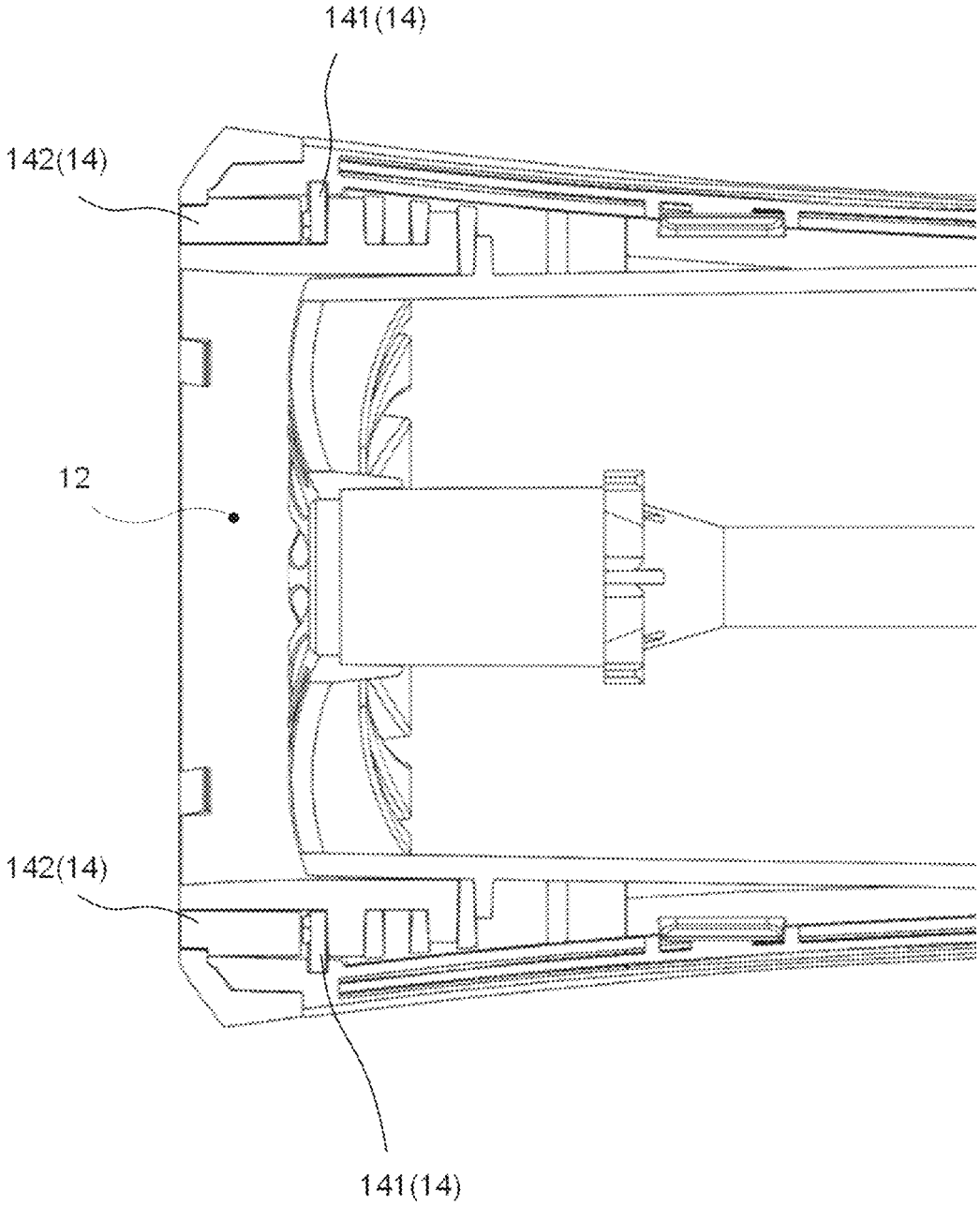
FIG. 10 is a sectional view illustrating the vicinity of the outlet port 12.
Figure 11:
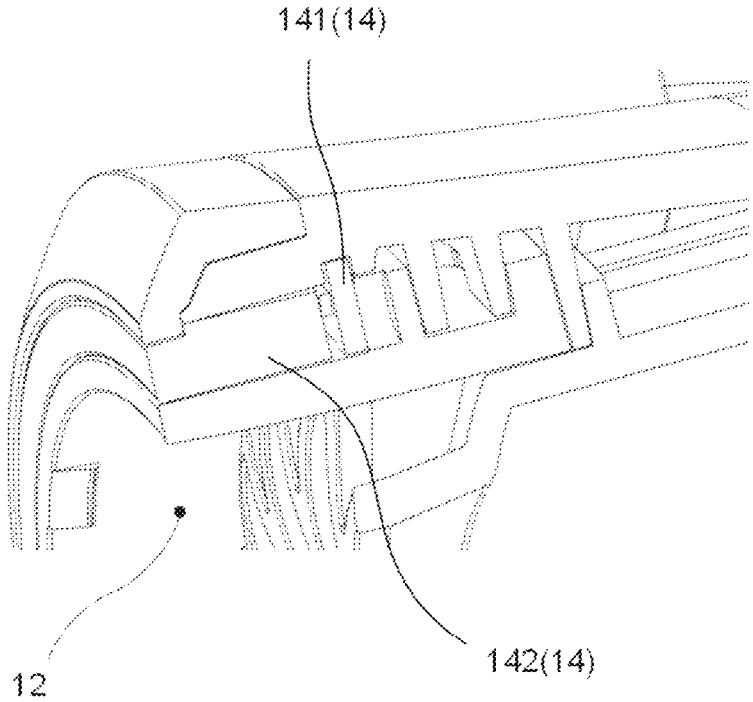
FIG. 11 is a perspective sectional view illustrating the vicinity of the outlet port 12.

Next, the light emission unit 14 will be described. FIG. 10 is a sectional view illustrating the vicinity of the outlet port 12, and FIG. 11 is a perspective sectional view illustrating the vicinity of the outlet port 12. As illustrated in FIGS. 10 and 11, the light emission unit 14 includes two or more light sources 141. These light sources 141 are, for example, LEDs (light emitting diodes). In other words, the hair dryer 1 includes two or more light sources 141. The light sources 141 are disposed at positions on the outer circumference of the outlet port 12, the positions not interfering with the flow path of the airflow. The light sources 141 are disposed at positions not interfering with the flow path of the airflow so that the airflow is hindered from heating the light sources 141 and that the light sources 141 are hindered from causing turbulence in the airflow. In addition, the light sources 141 can be brought closer to the scalp and the hair, and thus it can be expected to enhance the beauty effect of the light.

A cover 142 is disposed on the side where light is emitted from the light sources 141. This cover 142 can have a similar function to a collimator that diffuses the light emitted from the light sources 141 or that converts the light into collimated light. The light sources 141 include a first light source emitting red light and a second light source emitting infrared light.

6. Expander and Expansion Unit

Figure 12:
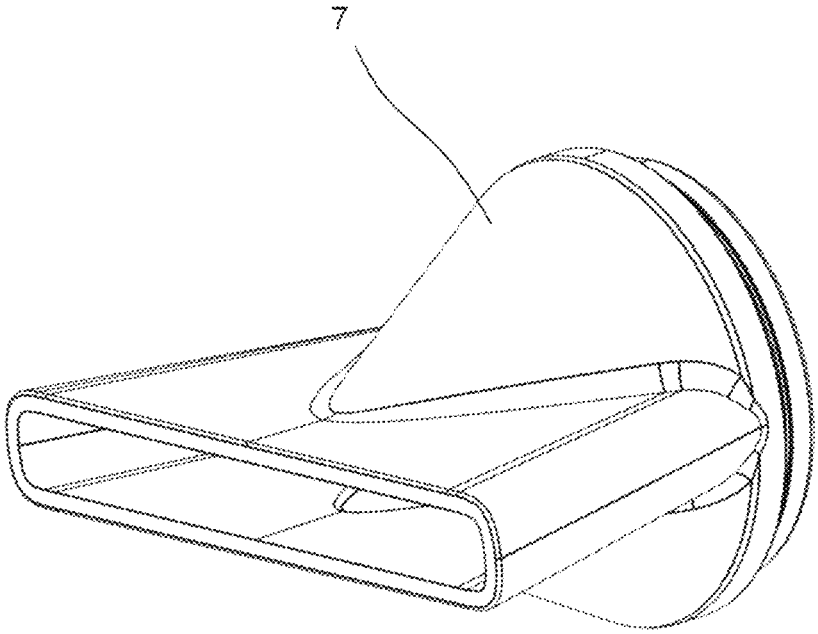
FIG. 12 is a diagram illustrating an example of an expansion unit.
Figure 13:
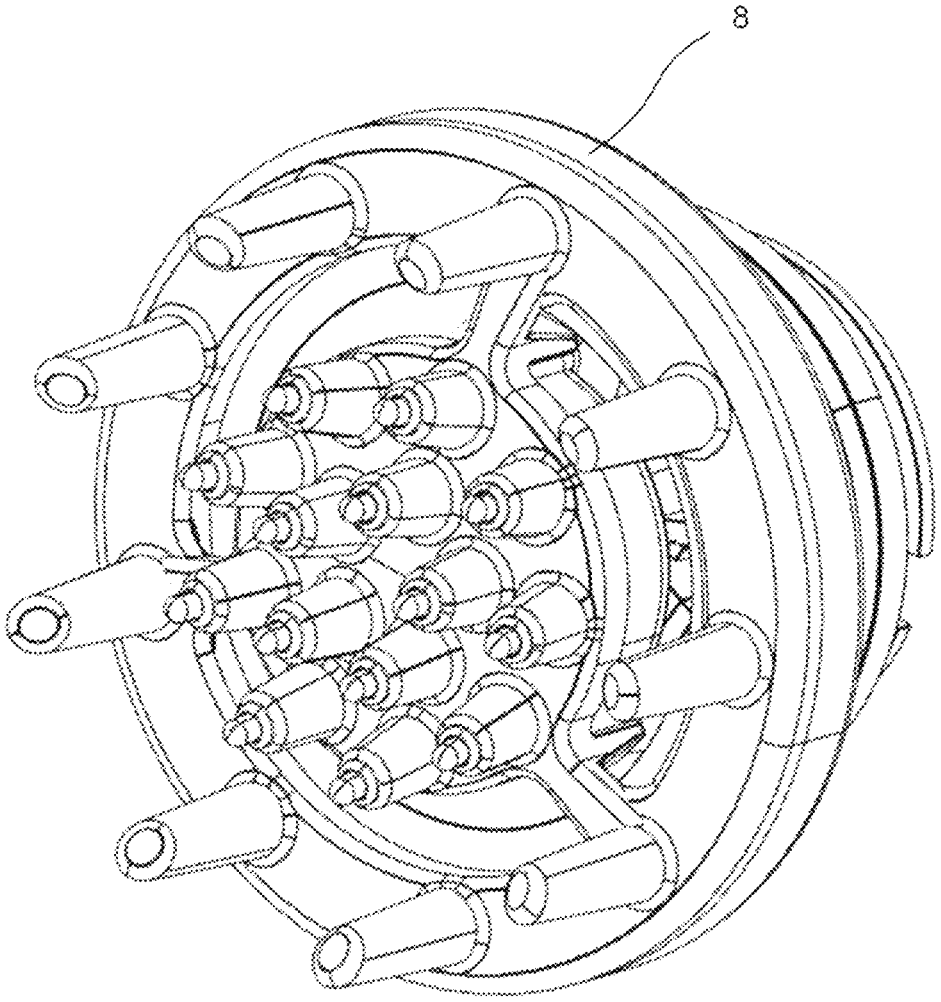
FIG. 13 is a diagram illustrating an example of the expansion unit.

Next, the expander 13 will be described. The expander 13 is configured to be attachable to an expansion unit. For example, a hair-set nozzle 7 illustrated in FIG. 12 and a scalp moisture head 8 illustrated in FIG. 13 are examples of the expansion unit attachable to the expander 13. FIG. 12 and FIG. 13 are diagrams illustrating examples of the expansion unit.

The hair-set nozzle 7 is an expansion unit useful for hair setting and has a function of concentrating the air that blows out from the outlet port 12. The scalp moisture head 8 is an expansion unit for providing the scalp with vibration and electrical stimulation. Based on power supplied via the expander 13, the scalp moisture head 8 provides scalp or facial skin with at least one of voltage, warmth, vibration, visible light, and infrared light. The scalp moisture head 8 can be used not only on the scalp but also on skin of face, etc. and can provide the skin of the face, etc. with vibration, electrical stimulation, and light stimulation.

Figure 14:
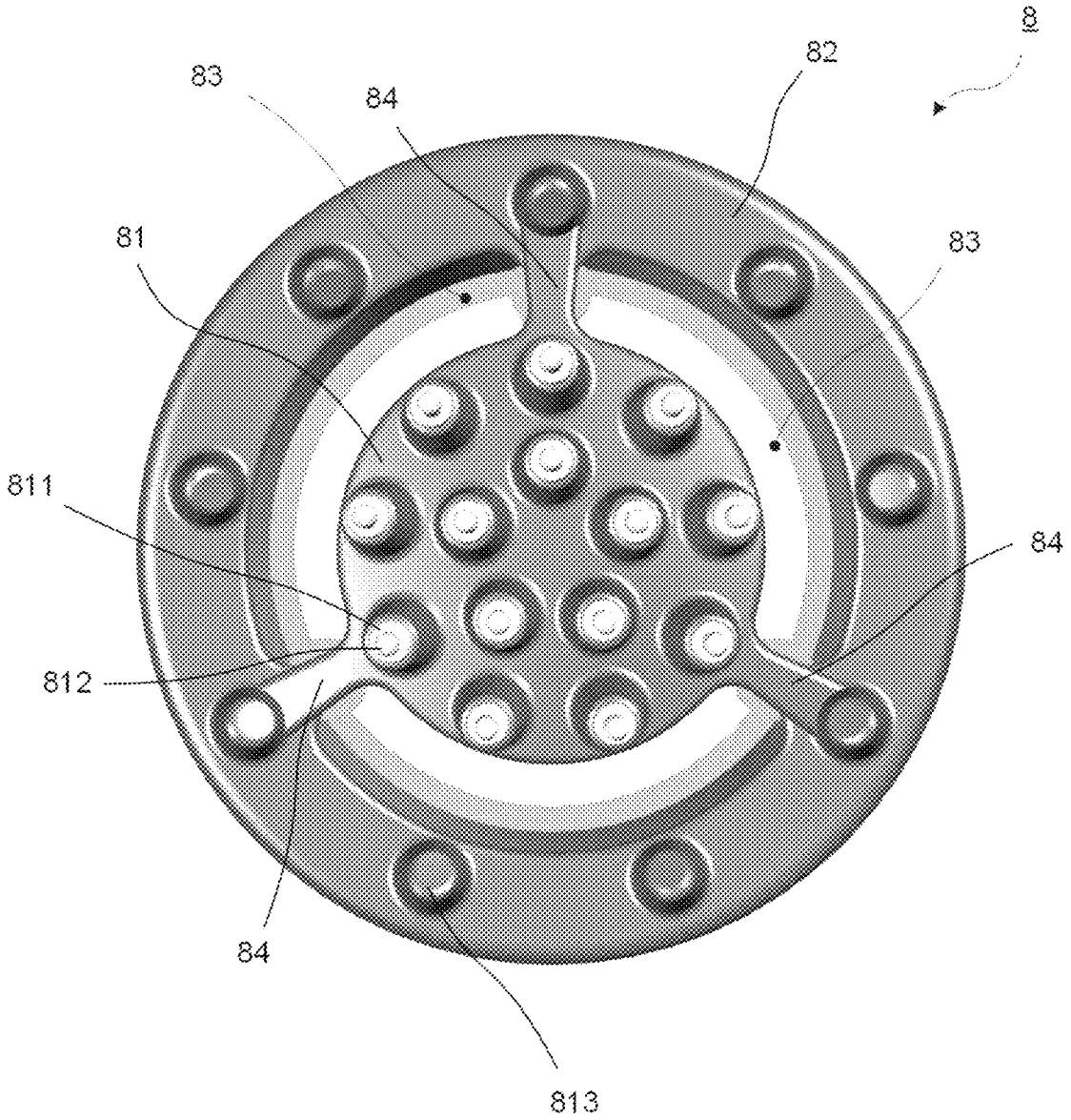
FIG. 14 is a front view of a scalp moisture head 8.
Figure 15:
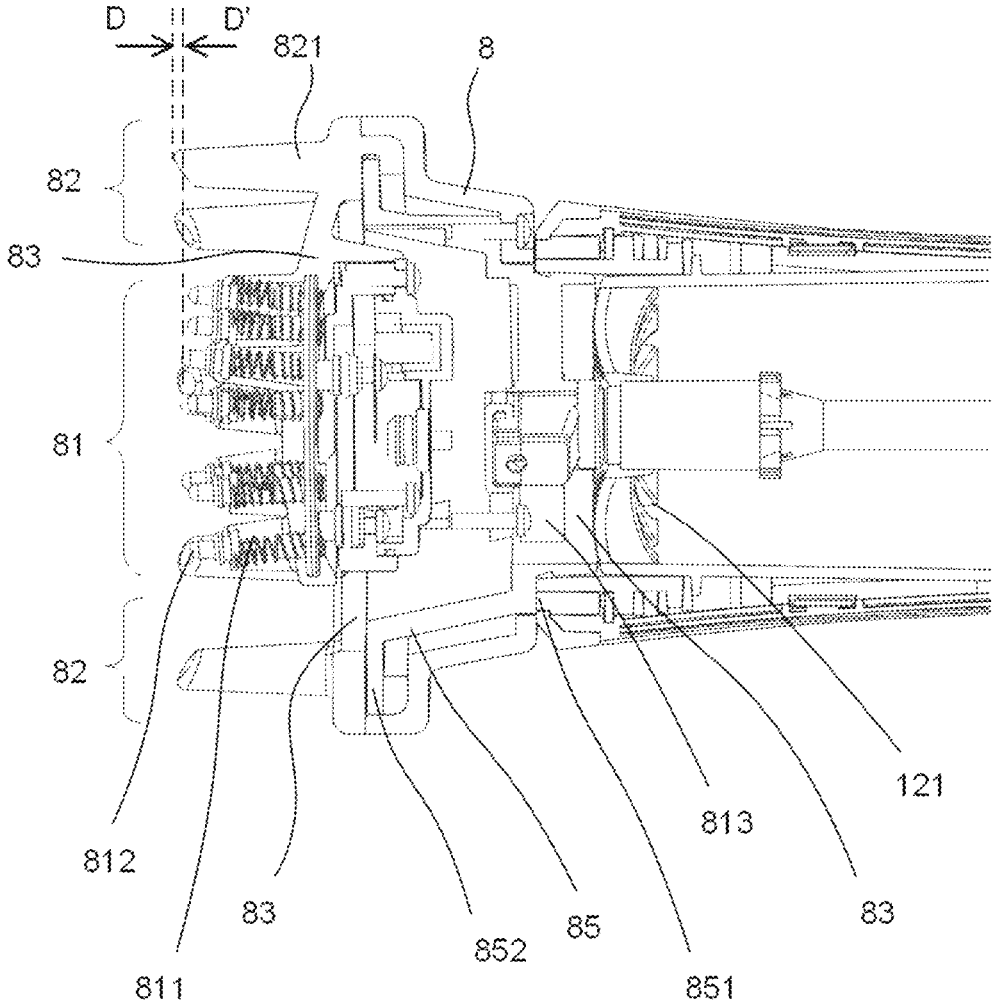
FIG. 15 is a sectional view of a lateral side of the scalp moisture head 8.

Here, the scalp moisture head 8 will be described. FIG. 14 is a front view of the scalp moisture head 8, and FIG. 15 is a sectional view of a lateral side of the scalp moisture head 8. Here, the front side of the scalp moisture head 8 is assumed to be the side of a surface to be in contact with the scalp or the skin of the face, etc. As illustrated in FIG. 14 and FIG. 15, the scalp moisture head 8 includes a strong vibration area 81, a weak vibration area 82, and a ventilation hole 83. The scalp moisture head 8 also includes a light guide unit 85. The light guide unit 85 includes a light entering surface 851 and a light emission surface 852. The light guide unit 85 guides visible light or infrared light that has been emitted from the light sources 141 and been allowed to enter from the light entering surface 851 and then emits the light from the light emission surface 852 to the scalp or the facial skin.

The strong vibration area 81 is a surface that faces the scalp or the skin of the face, etc. and is part that provides the scalp with vibration. The strong vibration area 81 includes protrusions 811. Each protrusion 811 includes a contact 812 made of conductive material such as silicon, metal, etc. at its tip, and vibrates with motion of a vibration unit 813. When a human body touches the contact 812 and the hand electrode 22, a closed circuit including the human body is formed, making it possible that electric current, which is supplied from the hair dryer 1, passes through the human body. The vibration unit 813 includes a motor or the like and vibrates by power supplied from the hair dryer 1. The contact 812 may be divided into a positive electrode and a negative electrode so that the current passes through the human body without using the hand electrode 22.

The weak vibration area 82 is a surface that faces the scalp or the skin of the face, etc. and includes protrusions 821. Each protrusion 821 protrudes more on the scalp side than the protrusions 811. The weak vibration area 82 vibrates with motion of the vibration unit 813, but the vibration of the weak vibration area 82 is weaker than the vibration of the strong vibration area 81.

The ventilation hole 83 is part through which the airflow blowing out from the outlet port 12 passes. This ventilation hole 83 may include two or more holes in the center or around the center and thereby have the same area as the blow ports 121.

The strong vibration area 81 and the weak vibration are 82 are connected by connection units 84. Each connection unit 84 transmits the vibration of the strong vibration area 81 to the weak vibration area 82 and holds the strong vibration area 81 in such a manner that the strong vibration area 81 can freely vibrate, and the number of the connection units 84 may be three.

The protrusions 811 in the strong vibration area 81 and the protrusions 821 in the weak vibration area 82 have different heights, as represented by an arrow D and an arrow D' in FIG. 15. This difference in height is, for example, 1 mm. The difference in height may be 0.8 mm, 0.9 mm, 1.1 mm, or 1.2 mm, or may be between any two of the values given here (including 1.0 mm). Since the protrusions 821 in the weak vibration area 82 are longer than the protrusions 811 in the strong vibration area 81, when the scalp moisture head 8 is applied to the scalp, the face, or the like, the protrusions 821 face the skin surface while serving as pillars or the like, and then when the strong vibration area 81 vibrates, the protrusions 811 provide the skin with moderate stimulation.

Furthermore, by using an elastic member for the connection units 84, the strong vibration area 81 taps the skin with a moderate amplitude. When the number of the connection units 84 is four or more, the vibration amplitude of the strong vibration area 81 will be small, and when the number of the connection units 84 is two or less, left-right motion of the strong vibration area 81 will be severe, and therefore the number of the connection units 84 may be three, which allows tapping on the skin with a moderate vibration amplitude.

Figure 16:
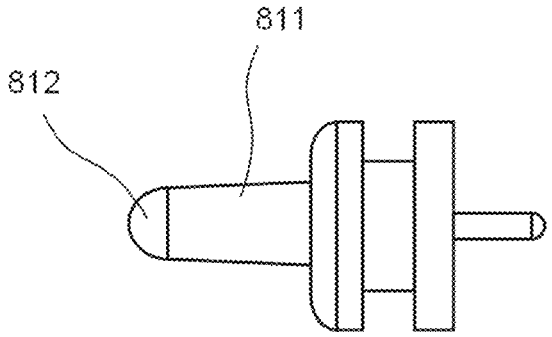
FIG. 16 is a diagram illustrating a shape of a contact 812.

Next, a description will be given of the contacts 812 provided on the protrusions 811. FIG. 16 is a diagram illustrating a shape of a contact 812. As illustrated in the drawing, each contact 812 has a hemispherical shape. The smaller the radius of this shape, the more likely the contact 812 to pass through the hair and contact the scalp, and the larger the radius of this shape, the larger an area for contacting the scalp and the larger an area for applying electrical stimulation and therefore the softer provided stimulation. The size of the hemisphere is, for example, 1.10 mm in radius. The radius of the hemisphere may be 1.00 mm, 1.05 mm, 1.15 mm, 1.20 mm, etc., or may be between any two of the values (including 1.10 mm) given here. In a case where the scalp moisture head 8 is to be used exclusively for the skin of the face, etc., the contact 812 may be a hemisphere with a radius of about 1.5 mm. This is because a preferable size depends on the presence or absence of hair.

7. Output Control Unit

Next, the output control unit 61 will be described. The output control unit 61 as an output controller is configured to change the flow rate and the temperature of the airflow by controlling the driver 40 and the heater 50. The heater 50 is configured to heat the airflow. The output control unit 61 changes at least one of the flow rate of the airflow and the temperature of the airflow between a state where expansion unit is not attached to the expander 13 and a state where an expansion unit is attached to the expander 13. For example, when the scalp moisture head 8 is attached as an expansion unit, the output control unit 61 controls the flow rate and the temperature of the airflow as illustrated in FIG. 17.

FIG. 17 is a diagram illustrating an example of control performed by the output control unit 61. In the example given in the figure, when the scalp moisture head 8 is not attached, the output control unit 61 sets the temperature to 60° C. at an air volume of 103,000 rpm (expressed as the rotational speed of the blower 30), to 80° C. at an air volume of 70,000 rpm, or to 50° C. at an air volume of 55,000 rpm, or maintains the temperature at a room temperature, i.e., make only the air volume changeable without heating by the heater 50. The output control unit 61 may also change the flow rate and the temperature of the airflow between when the scalp moisture head 8 as an expansion unit is used on the scalp and when the scalp moisture head 8 is used on the facial skin. Specifically, when the scalp moisture head 8 is attached and an operation is in a head mode for the scalp, the airflow is heated to a temperature of 50° C. and the air volume is set to 28,000 rpm, and when the scalp moisture head 8 is attached and an operation is in a face mode for the skin of the face, etc., the airflow is heated to a temperature of 39° C. and the air volume is set to 14,000 rpm, the air volume of 14,000 rpm being an air volume with which an air velocity becomes 17 m/s. The temperatures and the air volumes given here are examples, and for example, when the scalp moisture head 8 is attached and the operation is in the face mode, the temperature may be any temperature from about 35° C. to about 50° C.

The output control unit 61 is configured to control order of activation of the driver 40 and the heater 50 depending on the temperature inside the main body unit 10. In this case, the output control unit 61 may allow the heater 50 to intermittently operate. Specifically, a first threshold value and a second threshold value are defined for the temperature inside the main body unit 10, and when the temperature inside the main body unit 10 is equal to or higher than the first threshold value, the temperature is determined to be high, when the temperature inside the main body unit 10 is equal to or higher than the second threshold value and lower than the first threshold value, the temperature is determined to be medium, and when the temperature inside the main body unit 10 is lower than the second threshold value, the temperature is determined to be low, and in respective cases, different methods are used to activate the driver 40 and the heater 50. For example, the first threshold value is 65° C. and the second threshold value is 30° C. The temperature inside the main body unit 10 is measured by, for example, an unillustrated thermistor provided on the output control unit 61.

Figure 18:
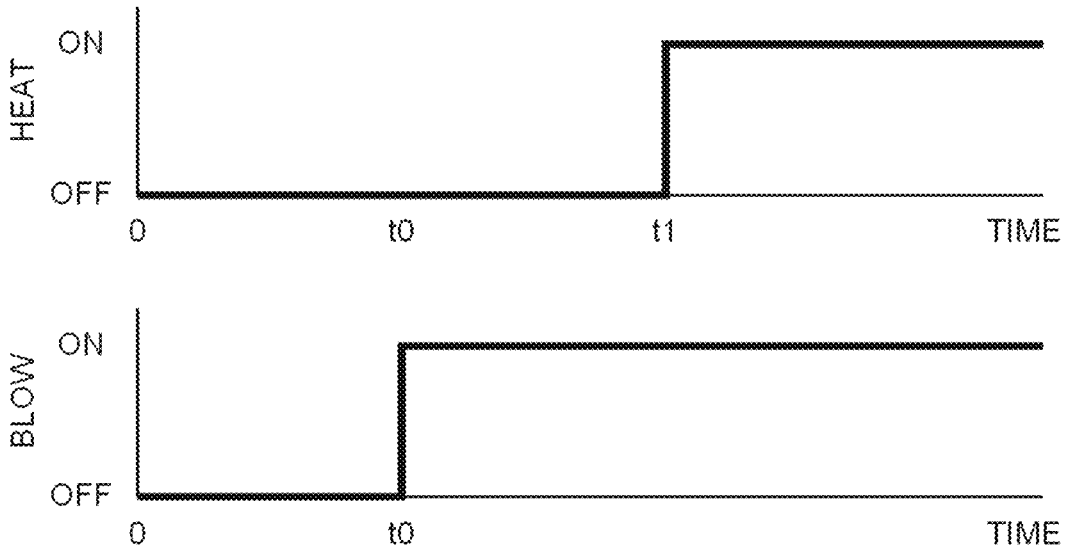
FIG. 18 is a diagram illustrating a method of activating the driver 40 and a heater 50 when the temperature inside the main body unit 10 is a high temperature.
Figure 19:
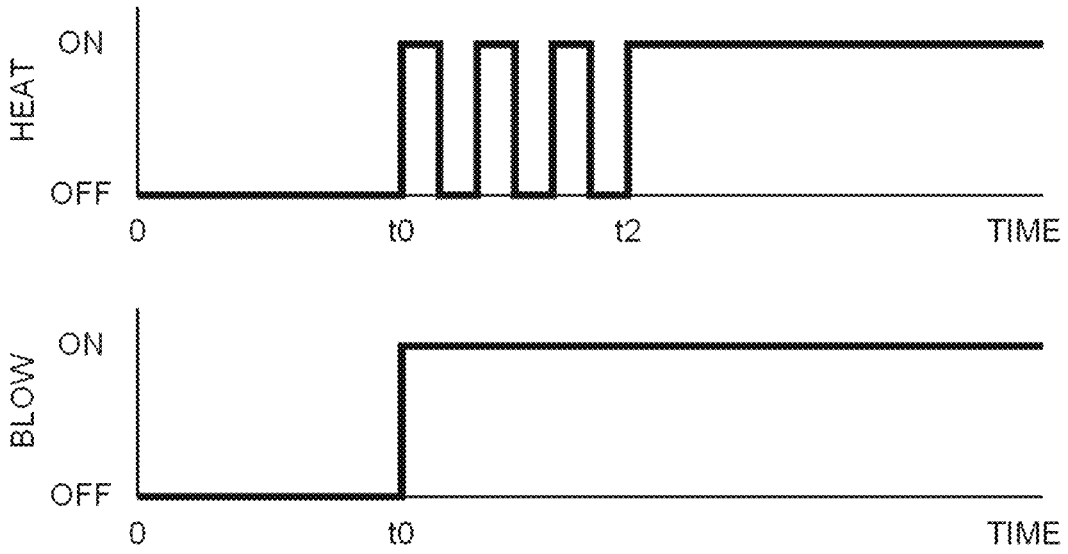
FIG. 19 is a diagram illustrating a method of activating the driver 40 and the heater 50 when the temperature inside the main body unit 10 is a medium temperature.
Figure 20:
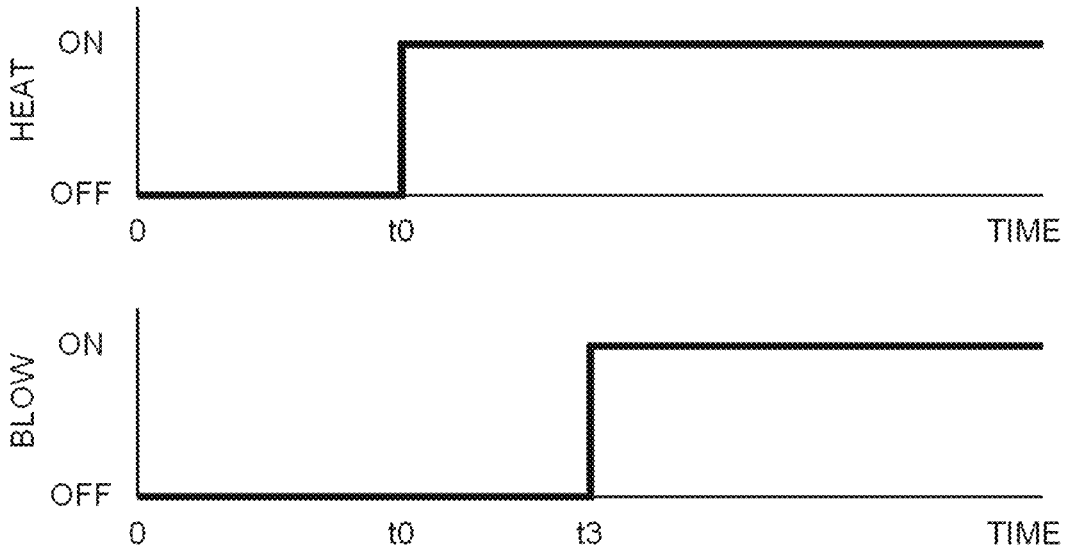
FIG. 20 is a diagram illustrating a method of activating the driver 40 and the heater 50 when the temperature inside the main body unit 10 is a low temperature.

FIG. 18 is a diagram illustrating a method for activating the driver 40 and heater 50 when the temperature inside the main body unit 10 is high, FIG. 19 is a diagram illustrating a method for activating the driver 40 and heater 50 when the temperature inside the main body unit 10 is medium, and FIG. 20 is a diagram illustrating a method for activating the driver 40 and the heater 50 when the temperature inside the main body unit 10 is low.

In a case where the temperature inside the main body unit 10 is high, when the switch 21 is operated at the time t0, the output control unit 61 first allows the driver 40 to operate and thereby starts air blowing. At this time, the heater 50 is not allowed to operate. Only air blowing is performed so that the inside of the main body unit 10 is cooled. Then, at the time t1 after a certain period of time, the heater 50 is allowed to operate and thereby warm air blows. The time t1 may be set to a different value depending on the temperature inside the main body unit 10, or the temperature inside the main body unit 10 may be measured and the time when the temperature lowers to a predetermined temperature may be regarded as the time t1.

In a case where the temperature inside the main body unit 10 is medium, when the switch 21 is operated at the time t0, the output control unit 61 starts air blowing by allowing the driver 40 to operate and allows the heater 50 to intermittently operate. Heating by the heater 50 is performed at about 90% of a rated value by adjusting a duty ratio, for example. Then, at the time t2 after a certain period of time, the heater 50 is allowed to normally operate. The time t2 may be set to a different value depending on the temperature inside the main body unit 10 or may be a time based on the temperature inside the main body unit 10. This makes it possible to hinder excessive heating at activation.

In a case where the temperature inside the main body unit 10 is low, when the switch 21 is operated at the time t0, the output control unit 61 first allows the heater 50 to operate. At this time, the driver 40 is not allowed to operate. Then, at the time t3 after a certain period of time, the driver 40 is allowed to operate and thereby warm air blows. This hinders the user of the hair dryer 1 from feeling discomfort caused by cold air blowing at activation.

Dryers are often designed to dry hair as quickly as possible. In order that a maximum heat amount (e.g., 1000 W) is provided when the air volume is maximum, a high-temperature medium-air volume mode is often set in which, from a state where rotational speed of a motor and heater output are set to those of a medium-temperature high-air volume mode, the rotational speed of the motor is lowered with the heater output maintained and thereby the blowing temperature is increased. Furthermore, in recent years, there has been a growing demand for a low-temperature high-air volume dryer hindered from damaging the hair and scalp, and there have been cases of setting a medium-temperature medium-air speed mode in which, from a state where a low-temperature high-air volume mode (e.g., 60° C.) is set by lowering the heater output (e.g., to 900 W), the rotational speed of the motor is lowered with the heater output maintained.

However, since a high temperature (e.g., 80° C.) necessary to remove hair waviness cannot be provided in the medium-temperature medium-air volume mode, a dryer has been made in which the heater rated output is further increased (e.g., to 1200 W) and the heater output (e.g., of three levels) and the rotational speed of the motor (e.g., of three levels) are freely combined. In this case, operation at the maximum heater output (1200 W) and the maximum motor rotation results in over drying of the hair and the scalp, causing scalp problems, etc.

Thus, the blower 30 of the hair dryer 1 is configured to adjust the flow rate of the airflow in two or more levels, and the heater 50 is configured to heat the airflow to two or more temperature levels, wherein when the flow rate of the airflow is at the maximum level, the airflow cannot be heated to the highest temperature level. For simplicity of explanation, when the blower 30 is assumed to be configured to adjust the flow rate of the airflow in two levels of high and low and the heater 50 is configured to heat the airflow in two temperature levels of high and low, the heater 50 heats the airflow only to the low temperature when the flow rate of the airflow is high. For example, the heater 50 is configured to adjust the temperature by adjusting the duty ratio as illustrated in from time t0 to time t2 in FIG. 19.

The hair dryer 1 may include the following switch and thereby be configured to adjust the heating temperature of the airflow by the heater 50. The switch is configured to specify a high or low flow rate of the airflow and a high or low temperature of the airflow, and when the switch specifies the high flow rate of the airflow, the switch specifies only the low temperature of the airflow.

Figure 21:
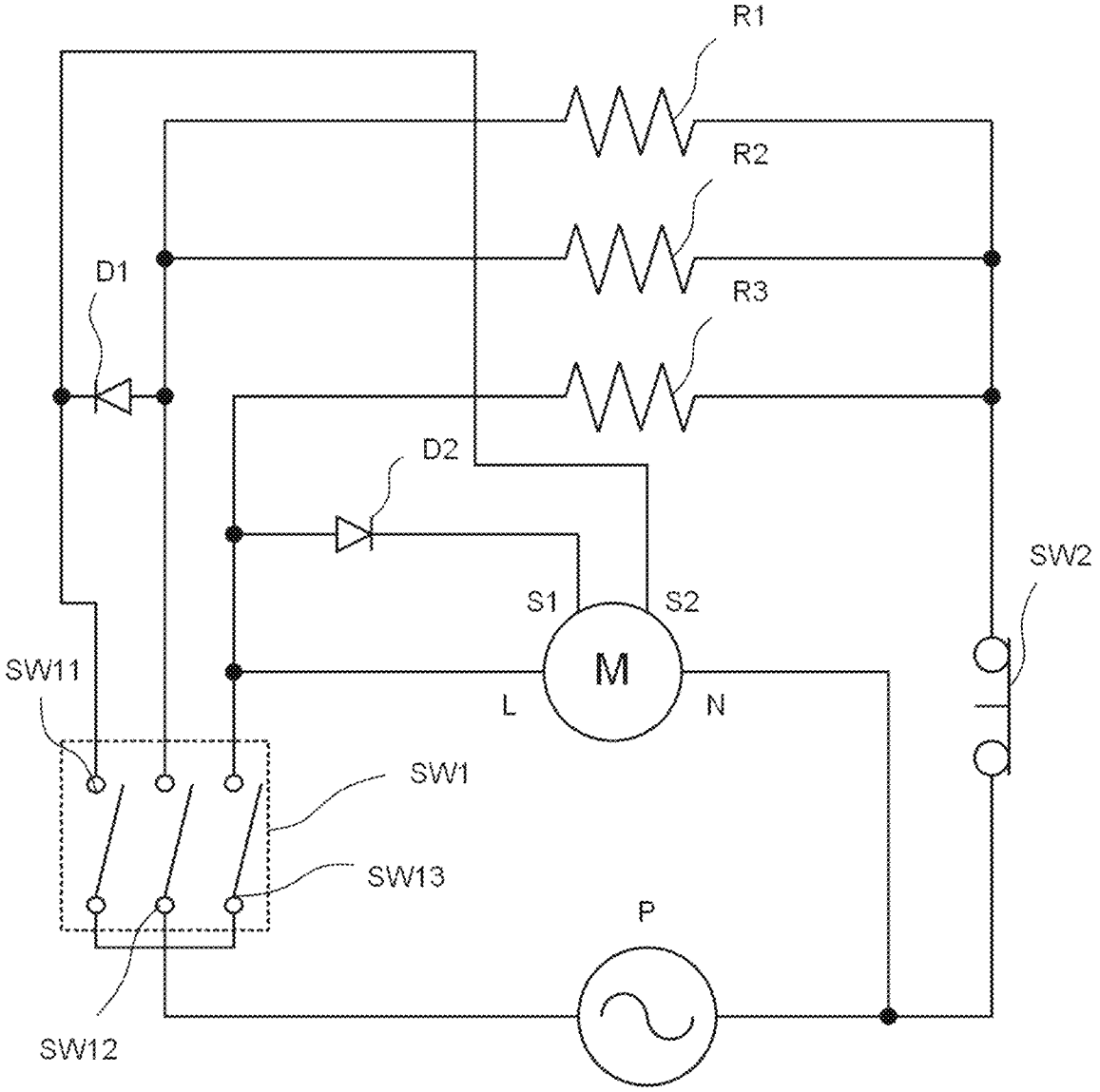
FIG. 21 is a diagram illustrating a configuration example of a circuit.

Here, a description will be given of an example of a circuit configured to adjust, by using a switch, temperature of a heater corresponding to the heater 50. FIG. 21 is a diagram illustrating a configuration example of the circuit, and FIG. 22 is a diagram for describing the operation of the circuit illustrated in FIG. 21.

The circuit illustrated in FIG. 21 includes a power supply P, a motor M, a heater R1, a heater R2, a heater R3, a diode D1, a diode D2, a switch SW1, and a switch SW2. The power supply P corresponds to a commercial power source. The motor M includes a brushless motor and its controller. The controller is configured to drive the brushless motor by converting voltage applied to between terminal L and the terminal N into direct current voltage or three-phase alternating current voltage, and to vary the rotational speed of the brushless motor in response to voltage input to the terminal S1 and the terminal S2. Each of the heater R1, the heater R2, and the heater R3 heats the airflow and is equivalent to a resistor in an electric circuit. The diode D1 and the diode D2 restrict the current flow. The switch SW1 can be equivalently represented as including three internal switches of a switch SW11, a switch SW12, and a switch SW13, and is configured to specify the amount and the temperature of the airflow. The switch SW2 is configured to switch whether or not the airflow is to be heated.

When the switch SW11 is closed, a half-wave current flows through the heater R1 and the heater R2 via the diode D1, and a full-wave voltage is applied to the terminal S2 of the motor M. However, when the switch SW2 is open, no current flows through the heater R1 and the heater R2.

When the switch SW12 is closed, a full-wave current flows through the heater R1 and the heater R2, and a half-wave voltage is applied to the terminal S2 of the motor M. However, when the switch SW2 is open, no current flows through the heater R1 and the heater R2.

When the switch SW13 is closed, a full-wave current flows through the heater R3 and a half-wave voltage is applied to the terminal S1 of the motor M. However, when the switch SW2 is open, no current flows through the heater R3.

The switch SW1 can be switched to OFF, SET, DRY, or TURBO. When the switch SW1 is switched to OFF, the switch SW11, the switch SW12, and the switch SW13 are all opened (OFF) and the motor M, the heater R1, the heater R2, and the heater R3 are all stopped. When the switch SW1 is switched to SET, the switch SW11 and the switch SW12 are opened and the switch SW13 is closed. This allows a half-wave voltage to be applied to the terminal S1 of the motor M and full-wave current to flow through the heater R3.

When the switch SW1 is switched to DRY, the switch SW11 is opened and the switch SW12 and the switch SW13 are closed. As a result, a half-wave voltage is applied to the terminal S1 and the terminal S2 of the motor M, and full-wave current flows through the heater R1, the heater R2, and the heater R3. When the switch SW1 is switched to TURBO, the switch SW11 is closed, the switch SW12 is opened, and the switch SW13 is closed. This allows a half-wave voltage to be applied to the terminal S1 of the motor M and a full-wave voltage to be applied to the terminal S2. Furthermore, half-wave current flows through the heater R1 and the heater R2, and full-wave current flows through the heater R3.

Thus, the switch SW1 switched to SET causes a temperature of 50° C., an air volume of 55,000 rpm, and 400 W. The switch SW1 switched to DRY causes a temperature of 80° C., an air volume of 70,000 rpm, and 1100 W. The switch SW1 switched to TURBO causes a temperature of 60° C., an air volume of 103,000 rpm, and 770 W.

8. Charge Emission and Collection

Figure 23:
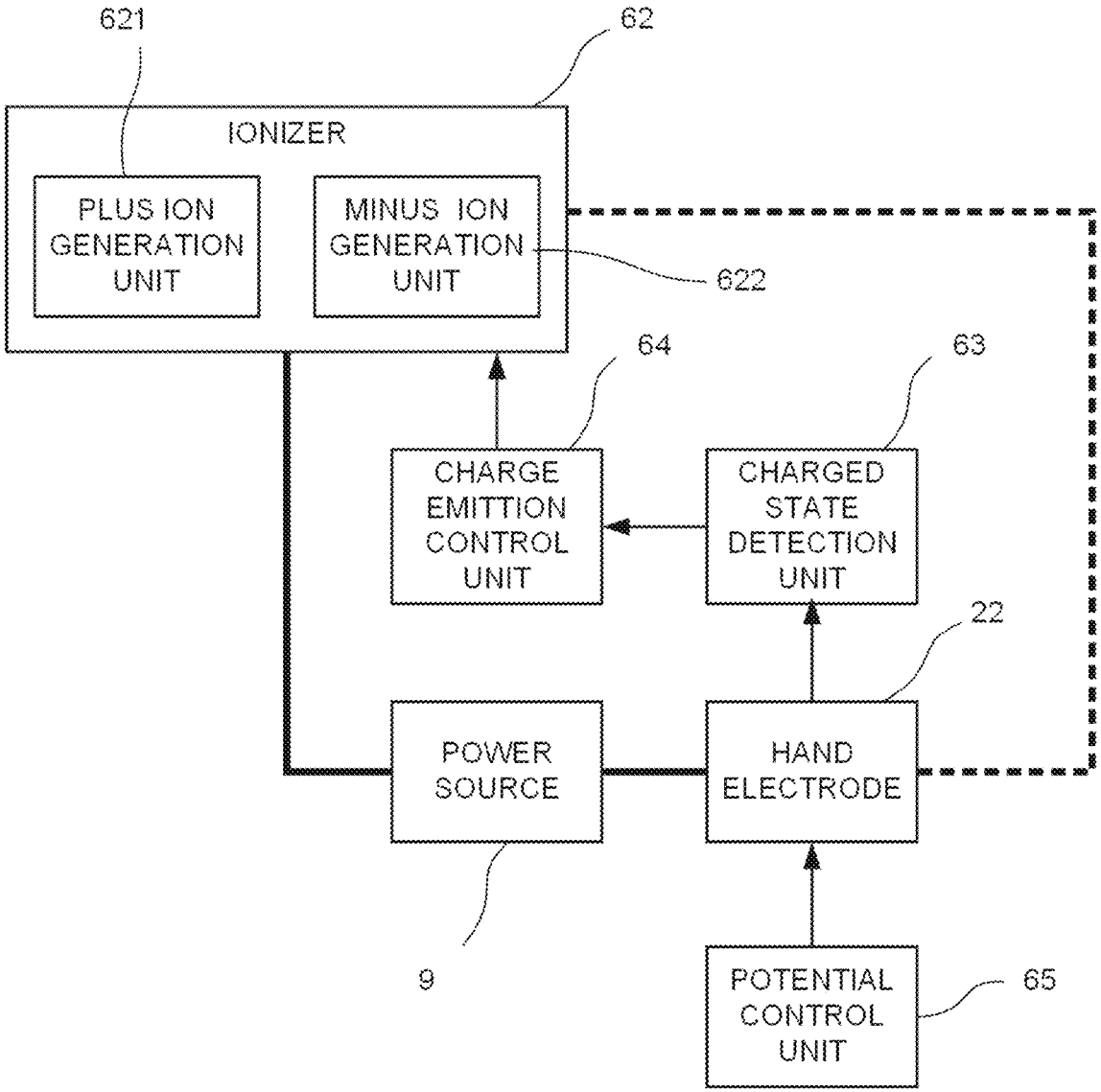
FIG. 23 is a block diagram illustrating a configuration example of a function of emitting and collecting electric charges.

Next, a description will be given of charge emission by the ionizer 62 and charge collection by the hand electrode 22. FIG. 23 is a block diagram illustrating a configuration example of functions of emitting and collecting charge.

As illustrated in the drawing, the ionizer 62 as a charge emitter includes a positive ion generation unit 621 configured to generate positive ions and a negative ion generation unit 622 configured to generate negative ions, and thereby is configured to generate a positive ion and a negative ion simultaneously or alternately. The charge collector includes a hand electrode 22 configured to be in contact with the user. The hand electrode 22 is connected to a potential control unit 65 as a potential controller configured to control potential of the hand electrode 22. This potential control unit 65 can control the potential of the hand electrode 22 and can, for example, apply ground potential to the hand electrode 22. This allows the hand electrode 22 to collect negative charge when more negative ions accumulate in the hair and to collect positive charge when more positive ions accumulate in the hair so as to quickly neutralize the hair, and it is possible to expect to provide negative ions and effects secondary provided by the negative ions, such as increased moisture. The potential control unit 65 may be insulated from a commercial power source.

A charged state detection unit 63 as a charged state detector and a charge emission control unit 64 as a charge emission controller may also be provided. The charged state detection unit 63 is configured to detect a charged state of the user. The charge emission control unit 64 is configured to control an emission amount of at least one of positive ions and negative ions emitted from the ionizer 62 so that the charged state of the user becomes a predetermined state.

9. Others

The present invention may be provided in each of the following forms.

In the hair dryer, the heat dissipater is aluminum or aluminum alloy.

In the hair dryer, the frame includes an inner wall and an outer wall, and the heat dissipater is disposed between the inner wall and the outer wall In the hair dryer, the heat dissipater is a diffuser vane configured to regulate the airflow.

In the hair dryer, the inner wall encases the winding, and part of the airflow flows on an inner side of the inner wall.

In the hair dryer, the blower is an impeller made of magnesium or magnesium alloy.

In the hair dryer, the outlet port includes two or more blow ports, and each of the blow ports has a shape that continuously narrows a flow path of the airflow and then continuously widens the flow path.

In the hair dryer, each of the blow ports has a shape that curves a direction of the airflow toward an outer circumferential direction of the outlet port.

The hair dryer includes an expander configured to allow attachment of an expansion unit, wherein, based on power supplied via the expander, the expansion unit provides scalp or facial skin with at least one of voltage, warmth, vibration, visible light, and infrared light.

The hair dryer includes a heater configured to heat the airflow, and an output controller configured to change a flow rate and temperature of the airflow by controlling the driver and the heater, wherein the output controller changes at least one of the flow rate of the airflow and temperature of the airflow between a state where the expansion unit is not attached to the expander and a state where the expansion unit is attached to the expander.

In the hair dryer, the output controller is configured to change the flow rate and the temperature of the airflow between when the expansion unit is used on scalp and when the expansion unit is used on facial skin.

The hair dryer includes a heater configured to heat the airflow, and an output controller configured to control order activation of the driver and the heater depending on a temperature inside the main body unit.

In the hair dryer, the output controller allows the heater to intermittently operate.

The hair dryer includes the blower configured to adjust a flow rate of the airflow in two or more levels, and a heater configured to heat the airflow to two or more temperature levels, wherein when the flow rate of the airflow is at a maximum level, the heater does not heat the airflow to a highest temperature level.

In the hair dryer, the blower is configured to adjust the flow rate of the airflow in two levels of high and low, and the heater is configured to heat the airflow to two temperature levels of high and low, wherein when the flow rate of the airflow is high, the heater heats the airflow only to the low temperature.

The hair dryer includes a switch configured to specify the high or low flow rate of the airflow and the high or low temperature of the airflow, wherein when the switch specifies the high flow rate of the airflow, the switch specifies only the low temperature of the airflow.

The hair dryer includes a charge emitter configured to generate a positive ion and a negative ion simultaneously or alternately, and a charge collector including an electrode configured to be in contact with a user, and a potential controller configured to control potential of the electrode.

The hair dryer includes a charged state detector configured to detect a charged state of the user, and a charge emission controller configured to control an emission amount of at least one of the positive ion and the negative ion, which are emitted by the charge emitter, so that the charged state of the user becomes a predetermined state.

The hair dryer includes two or more light sources disposed at positions on an outer circumference of the outlet port, the positions not interfering with a flow path of the airflow.

In the hair dryer, the light sources include a first light source configured to emit red light, and a second light source configured to emit infrared light.

In the hair dryer, the inlet port has a shape such that a section of a flow path of the airflow varies continuously.

An electric motor includes a winding, and a frame including an inner wall, an outer wall, and a heat dissipater disposed between the inner wall and the outer wall and configured to dissipate heat generated in the winding.

In the electric motor, the heat dissipater is made of aluminum or aluminum alloy.

The present invention is not limited to these.

What is claimed is:

1. A hair dryer comprising:

a main body unit including an inlet port at one end and an outlet port at the other end;

a blower disposed in the main body unit and configured to generate, in the main body unit, airflow flowing from the inlet port to the outlet port; and a driver including a motor and a frame encasing the motor, and configured to drive the blower by a rotation of the motor, the frame including an outer wall and a heat dissipater provided on an inner side of the outer wall, the heat dissipater being configured to dissipate, using the airflow, heat generated in a winding of the motor-, the inlet port being provided close to the frame and defining a flow path of the airflow, the inlet port having a shape such that a section of the flow path continuously decreases from a side opposite to the frame toward a side of the frame, the blower being arranged to cause the generated airflow to flow on the inner side of the outer wall, the main body unit having an outlet unit arranged on a side of the inlet port relative to the outlet port across the flow path of the airflow, the outlet unit including a center part and a plurality of blow ports provided along a circumferential direction around the center part and defining the flow path of the airflow, each of the plurality of blow ports having a first portion where the flow path continuously narrows in a direction along the airflow and a second portion connected to the first portion where the flow path continuously widens in the direction along the airflow.

2. The hair dryer according to claim 1, wherein the heat dissipater is made of aluminum or aluminum alloy.

3. The hair dryer according to claim 1, wherein:

the frame includes an inner wall, and the heat dissipater is disposed between the inner wall and the outer wall.

4. The hair dryer according to claim 3, wherein the heat dissipater is a diffuser vane configured to regulate a flow of the airflow.

5. The hair dryer according to claim 3, wherein the inner wall encases the winding, and part of the airflow flows on an inner side of the inner wall.

6. The hair dryer according to claim 1, wherein the blower is an impeller made of magnesium or magnesium alloy.

7. The hair dryer according to claim 1, wherein:

a length of the first portion in the direction along the airflow is larger than a length of the second portion in the direction along the airflow.

8. The hair dryer according to claim 7, wherein each of the blow ports has a shape that curves a direction of the airflow toward an outer circumferential direction of the outlet port.

9. The hair dryer according to claim 1, comprising an expander configured to allow attachment of an expansion unit, wherein, based on power supplied via the expander, the expansion unit provides scalp or facial skin with at least one of voltage, warmth, vibration, visible light, and infrared light.

10. The hair dryer according to claim 9, comprising:

a heater configured to heat the airflow; and an output controller configured to change a flow rate and temperature of the airflow by controlling the driver and the heater, wherein the output controller changes at least one of the flow rate of the airflow and the temperature of the airflow between a state where the expansion unit is not attached to the expander and a state where the expansion unit is attached to the expander.

11. The hair dryer according to claim 10, wherein the output controller is configured to change the flow rate and the temperature of the airflow between when the expansion unit is used on scalp and when the expansion unit is used on facial skin.

12. The hair dryer according to claim 1, comprising:

a heater configured to heat the airflow; and an output controller configured to control order of activation of the driver and the heater depending on a temperature inside the main body unit.

13. The hair dryer according to claim 12, wherein the output controller allows the heater to intermittently operate.

14. The hair dryer according to claim 1, comprising:

the blower configured to adjust a flow rate of the airflow in two or more levels; and a heater configured to heat the airflow to two or more temperature levels, wherein when the flow rate of the airflow is at a maximum level, the heater does not heat the airflow to a highest temperature level.

15. The hair dryer according to claim 14, wherein:

the blower is configured to adjust the flow rate of the airflow in two levels of high and low, and the heater is configured to heat the airflow to two temperature levels of high and low, wherein when the flow rate of the airflow is high, the heater heats the airflow only to the low temperature.

16. The hair dryer according to claim 15 comprising a switch configured to specify the high or low flow rate of the airflow and the high or low temperature of the airflow, wherein when the switch specifies the high flow rate of the airflow, the switch specifies only the low temperature of the airflow.

17. The hair dryer according to claim 1, comprising:

a charge emitter configured to generate a positive ion and a negative ion simultaneously or alternately; and a charge collector including:

an electrode configured to be in contact with a user; and a potential controller configured to control potential of the electrode.

18. The hair dryer according to claim 17, comprising:

a charged state detector configured to detect a charged state of the user; and a charge emission controller configured to control an emission amount of at least one of the positive ion and the negative ion, which are emitted by the charge emitter, so that the charged state of the user becomes a predetermined state.

19. The hair dryer according to claim 1, comprising two or more light sources disposed at positions on an outer circumference of the outlet port, the positions not interfering with a flow path of the airflow.

20. The hair dryer according to claim 19, wherein the light sources include:

a first light source configured to emit red light; and a second light source configured to emit infrared light.

21. The hair dryer according to claim 1, wherein an inner surface of the inlet port defining the flow path of the airflow is funnel-shaped.

* * * * *